US007183703B2

(12) United States Patent
Lim

(10) Patent No.: US 7,183,703 B2
(45) Date of Patent: Feb. 27, 2007

(54) CATHODE RAY TUBE AND MANUFACTURING METHOD OF DEFLECTION COIL

(75) Inventor: Se Cheon Lim, Jeonrabuk-do (KR)

(73) Assignee: LG.Philips Displays Korea Co., Ltd., Gumi-Si (KR)

( * ) Notice: Subject to any disclaimer, the term of this patent is extended or adjusted under 35 U.S.C. 154(b) by 248 days.

(21) Appl. No.: 10/703,559

(22) Filed: Nov. 10, 2003

(65) Prior Publication Data

US 2004/0263049 A1 Dec. 30, 2004

(30) Foreign Application Priority Data

Jun. 30, 2003 (KR) ..... 10-2003-0043289

(51) Int. Cl.
*H01J 29/70* (2006.01)

(52) U.S. Cl. ..... 313/440; 313/421; 313/441; 313/442; 335/210; 335/213; 335/296; 335/297

(58) Field of Classification Search ..... 313/421, 313/440, 441, 442; 335/210, 213, 296, 297
See application file for complete search history.

(56) References Cited

U.S. PATENT DOCUMENTS

| | | | | |
|---|---|---|---|---|
| 5,340,044 | A | 8/1994 | Doomernik et al. | |
| 5,955,830 | A * | 9/1999 | Uyama | 313/412 |
| 6,069,546 | A | 5/2000 | Azzi et al. | |
| 6,465,943 | B2 | 10/2002 | Nozawa et al. | |

* cited by examiner

*Primary Examiner*—Nimeshkumar D. Patel
*Assistant Examiner*—Anthony Canning
(74) *Attorney, Agent, or Firm*—Birch, Stewart, Kolasch & Birch, LLP

(57) ABSTRACT

A cathode ray tube comprises a panel having a fluorescent screen on an inner surface; a funnel connected to the panel, an electron gun housed in the funnel; emitting electron beams; and a shadow mask for selecting colors of the electron beams emitted from the electron gun, wherein the deflection yoke comprises a deflection coil for deflecting the electron beams in horizontal and vertical directions, a holder for insulating the deflection coil, and a ferrite core for reducing a magnetic field generated by the deflection coil, and an opening is formed on a flange portion of an opening section on a screen side of the deflection coil.

16 Claims, 7 Drawing Sheets

CATHODE RAY TUBE AND MANUFACTURING METHOD OF DEFLECTION COIL

BACKGROUND OF THE INVENTION

1. Field of the Invention

The present invention relates in general to a cathode ray tube and a manufacturing method of a deflection coil, more particularly, a cathode ray tube and a manufacturing method of a deflection coil including a deflection yoke having an opening formed on a flange section of an opening portion on a screen side of the deflection coil.

2. Discussion of the Background Art

FIG. 1 illustrates the structure of a related art cathode ray tube.

As depicted in FIG. 1, the color cathode ray tube includes a panel 1 and a funnel 2 connected to the panel 1, thereby maintaining inside thereof in vacuum state.

Inside the panel 1 is a fluorescent screen 3 containing R, G, and B fluorescent substances (or phosphors), and an electron gun 4 for emitting red, green and blue electron beams 7 is housed in a neck portion of the funnel 2 on the opposite side of the screen 3.

A shadow mask 5 for selecting colors is disposed at a predetermined position between the fluorescent screen 3 and the electron gun 4, more specifically, closer to the fluorescent screen 3, and there is an inner shield 6 made of magnetic material to reduce the movement of electron beams due to a magnetic field.

On the other hand, a convergence purity magnet (CPM) 8 and a deflection yoke 9 are mounted on the neck portion of the funnel 2. The CPM located on the side of the electron gun rearward of the deflection yoke 9 adjusts R, G, and B electron beams emitted from the electron gun 4 to converge on a point, and the deflection yoke 9 deflects the electron beams 7.

Also, a reinforcing band 10 is clamped to an outside skirt portion of the panel to reinforce the front surface glass under the influence of high vacuum state of the inside. Because the high vacuum tube is easily exploded by the external shocks, it is necessary to design the panel to be strong enough to withstand atmospheric pressure. For instance, the reinforcing band 10 on the outside skirt portion of the panel 1 distributes tension or stress acting on the high vacuum tube and thus, improves shock (or impacts) resistance of the cathode ray tube.

To briefly explain the operation of the color cathode ray tube with the above structure, the electron beams 7 emitted from the electron gun 4 are deflected vertically and horizontally by the deflection yoke 9, and the deflected electron beams 7 pass through beam passing holes on the shadow mask 5, and strike the fluorescent screen 3 on the front, consequently displaying desired color images.

FIG. 2 illustrates a more detailed structure of a deflection yoke.

Referring to FIG. 2, the deflection yoke 9 includes a horizontal deflection coil 21 for deflecting electron beams in the horizontal direction, and a vertical deflection coil 22 for deflecting electron beams in the vertical direction, a ferrite core 24 for minimizing a loss in a magnetic force generated by the horizontal and vertical deflection coils 21 and 22 on its return path, and a holder 23 for insulating between the horizontal and vertical deflection coils 21 and 22.

Generally, a horizontally deflected current having a frequency of 15.75 kHz or above travels in the horizontal deflection coil 21, and using a magnetic field generated around the coil, the deflection yoke deflects the electron beams 7 inside the cathode ray tube in the horizontal direction.

In like manner, a vertically deflected current having a frequency of 60 Hz travels in the vertical deflection coil 22, and using the magnetic field generated around the coil, the deflection yoke deflects the electron beams 7 inside the cathode ray tube in the vertical direction.

Therefore, an image gets displayed on the screen as the deflection yoke 9 deflects the electron beams 7 in the horizontal and vertical directions and converges them to a point on the screen.

One of currently developed deflection yokes is a self-convergence type deflection yoke, which uses non-uniform magnetic fields generated by the horizontal and vertical deflection coils 21 and 22, in order to converge R, G and B electron beams 7 on the screen without the help of a separate additional circuit or device.

In other words, by adjusting the turning distribution of the horizontal and vertical deflection coils 21 and 22, the self-convergence type deflection yoke creates a barrel or pin-cushion shaped magnetic field for each section (i.e., opening portion, middle portion, neck portion), and allows each of those three electron beams 7 to experience a different deflection force depending on their positions (yet to be converged upon one point despite different distances between the starting point to the arriving point on the screen), thereby striking a corresponding fluorescent screen more accurately.

Here, the opening portion on the screen side indicates a portion adjacent to the screen having a relatively greater diameter cross-section, and the opening portion on the neck side indicates a portion having a relatively less diameter cross-section on the opposite side of the screen side.

The middle portion, as the name implies, indicates a middle portion of the opening portion on the screen side and the neck portion on the neck side.

On the other hand, one of typical problems cathode ray tube manufacturers are faced with is that it is actually very difficult to deflect the electron beams 7 onto the full screen if they use only the magnetic fields generated around the horizontal and vertical deflection coils 21 and 22 by flowing the horizontally and vertically deflected currents into the coils. Hence, the ferrite core 24 with a high magnetic permeability is usually employed to minimize the loss in the magnetic fields generated by the horizontal and vertical deflections coils 21 and 22 on a return path of the magnetic fields, and further to improve a magnetic efficiency and magnetic force.

FIG. 3 illustrates a related art horizontal deflection coil.

As shown in the drawing, the horizontal deflection coil 21 is usually in a saddle shape, and using the magnetic field generated by the horizontal deflection coil 21, deflects electron beams in the horizontal direction.

However, the above horizontal deflection coil 21 alone is not sufficient to adjust an upper and lower distortions of the deflection yoke, so a correction member such as a plurality of ferrite sheets is attached to the flange portion of the opening section on the screen side to adjust the magnetic field being generated.

Moreover, to cancel a magnetic field leakage to outside, a cancel coil should be mounted at upper and lower portions of the screen side of the holder 23.

SUMMARY OF THE INVENTION

An object of the invention is to solve at least the above problems and/or disadvantages and to provide at least the advantages described hereinafter.

Accordingly, one object of the present invention is to solve the foregoing problems by providing a cathode ray tube including a deflection yoke that is effective for the adjustment of upper and lower distortions of the deflection yoke by forming an opening on a flange portion of an opening section on a screen side of the deflection coil.

Another object of the present invention is to provide a cathode ray tube including a deflection yoke with a minimized magnetic field leakage to outside.

Another object of the invention is to provide a manufacturing method of a deflection coil effective for the adjustment of number of turns by inserting a split pin into a flange portion of an opening section on a screen side of the deflection coil.

The foregoing and other objects and advantages are realized by providing a cathode ray tube, including: a panel having a fluorescent screen on an inner surface; a funnel connected to the panel, an electron gun housed in the funnel; emitting electron beams; and a shadow mask for selecting colors of the electron beams emitted from the electron gun, wherein the deflection yoke comprises a deflection coil for deflecting the electron beams in horizontal and vertical directions, a holder for insulating the deflection coil, and a ferrite core for reducing a magnetic field generated by the deflection coil, and an opening is formed on a flange portion of an opening section on a screen side of the deflection coil.

In an exemplary embodiment, a maximum length of the flange portion of the opening section on the screen side of the deflection coil, L, and a length of the flange portion of the opening section on the screen side, starting from the opening to the direction of a neck, H, satisfy a condition of $0.15 \leqq H/L \leqq 0.45$.

More preferably, the maximum length of the flange portion of the opening section on the screen side of the deflection coil, L, and the length of the flange portion of the opening section on the screen side, starting from the opening to the direction of a neck, H, satisfy a condition of $0.23 \leqq H/L \leqq 0.35$.

In an exemplary embodiment, the opening is formed within ±45 degrees from a center of the deflection coil.

In an exemplary embodiment, the deflection coil is a horizontal deflection coil.

In an exemplary embodiment, a number of turns of the deflection coil covering a length (H) of the flange portion of the opening section on the screen side from the opening to the direction of the neck ranges from 2 to 7.

Preferably, the number of turns of the deflection coil covering the length (H) of the flange portion of the opening section on the screen side from the opening to the direction of the neck ranges from 2 to 5.

Another aspect of the invention provides a cathode ray tube, including: a panel having a fluorescent screen on an inner surface; a funnel connected to the panel, an electron gun housed in the funnel; emitting electron beams; and a shadow mask for selecting colors of the electron beams emitted from the electron gun, wherein the deflection yoke comprises a deflection coil for deflecting the electron beams in horizontal and vertical directions, a holder for insulating the deflection coil, and a ferrite core for reducing a magnetic field generated by the deflection coil, and a flange portion of an opening section on a screen side of the deflection coil is split into at least two areas.

Still another aspect of the invention provides a manufacturing method of a deflection coil for deflecting electron beams in horizontal and vertical directions, the method comprising the steps of inserting the deflection coil between an upper former and a lower former; and forming an opening by inserting a split pin on a flange portion of an opening section on a screen side of the deflection coil.

Also, the split pin is inserted within ±15 degrees from a center of the deflection coil.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein.

DETAILED DESCRIPTION OF PREFERRED EMBODIMENTS

The following detailed description will present a cathode ray tube according to a preferred embodiment of the invention in reference to the accompanying drawings.

Figure 1:
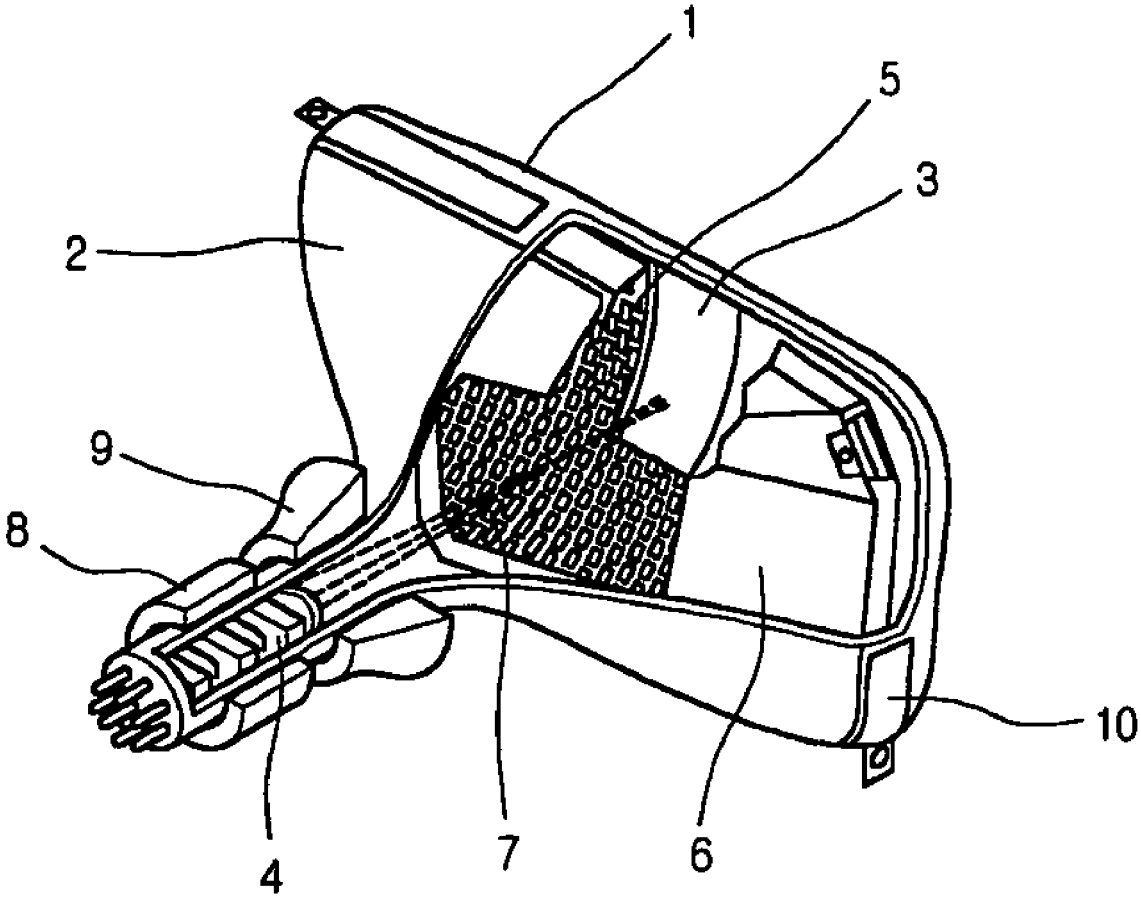
Fig.1 Related Art
FIG. 1 illustrates the structure of a related art cathode ray tube.
Figure 2:
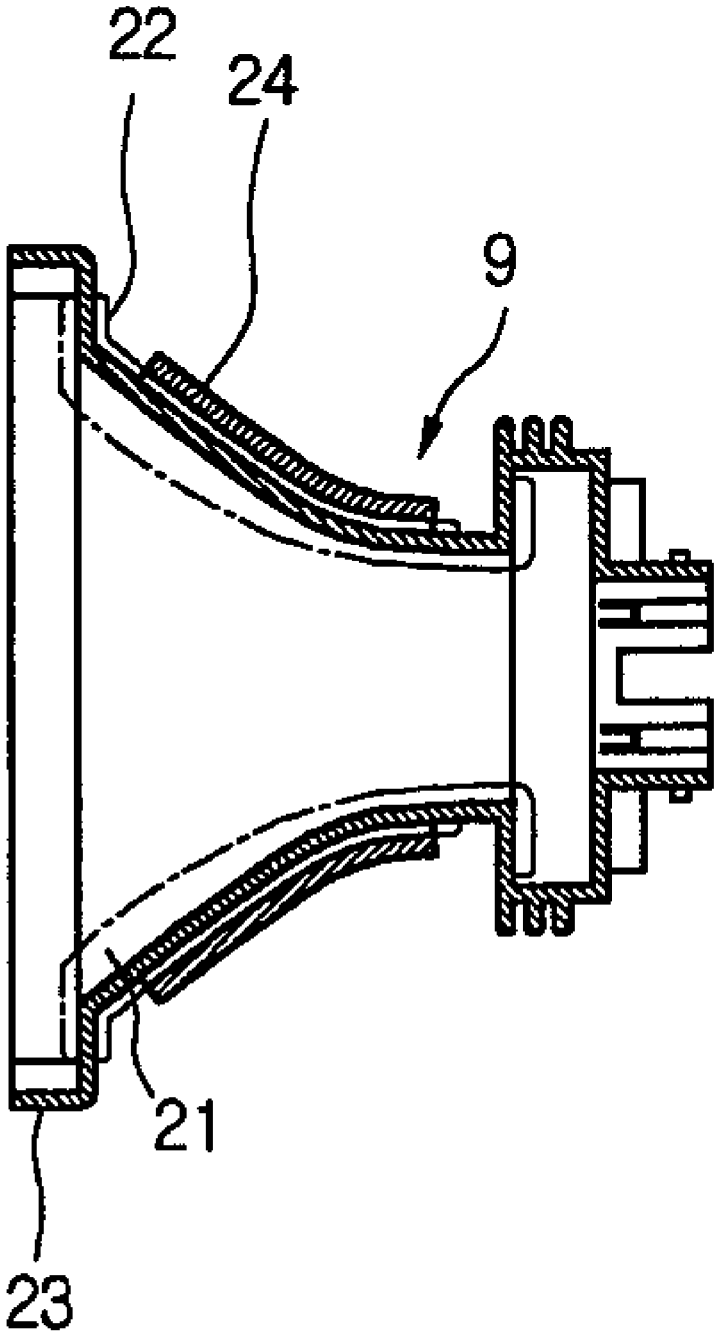
Fig.2 Related Art
FIG. 2 illustrates a detailed structure of a deflection yoke.
Figure 3:
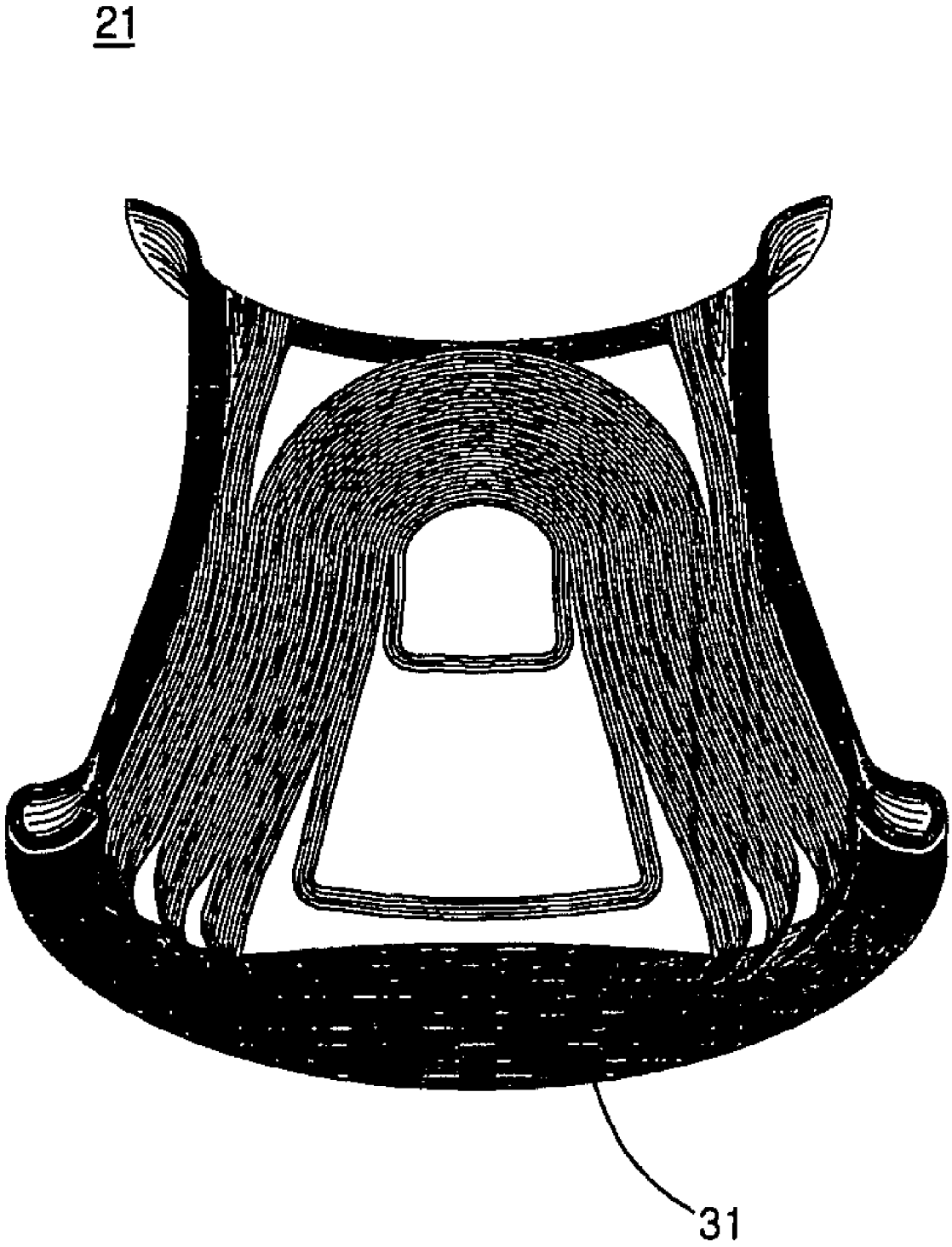
Fig.3 Related Art
FIG. 3 illustrates a related art horizontal deflection coil.
Figure 4:
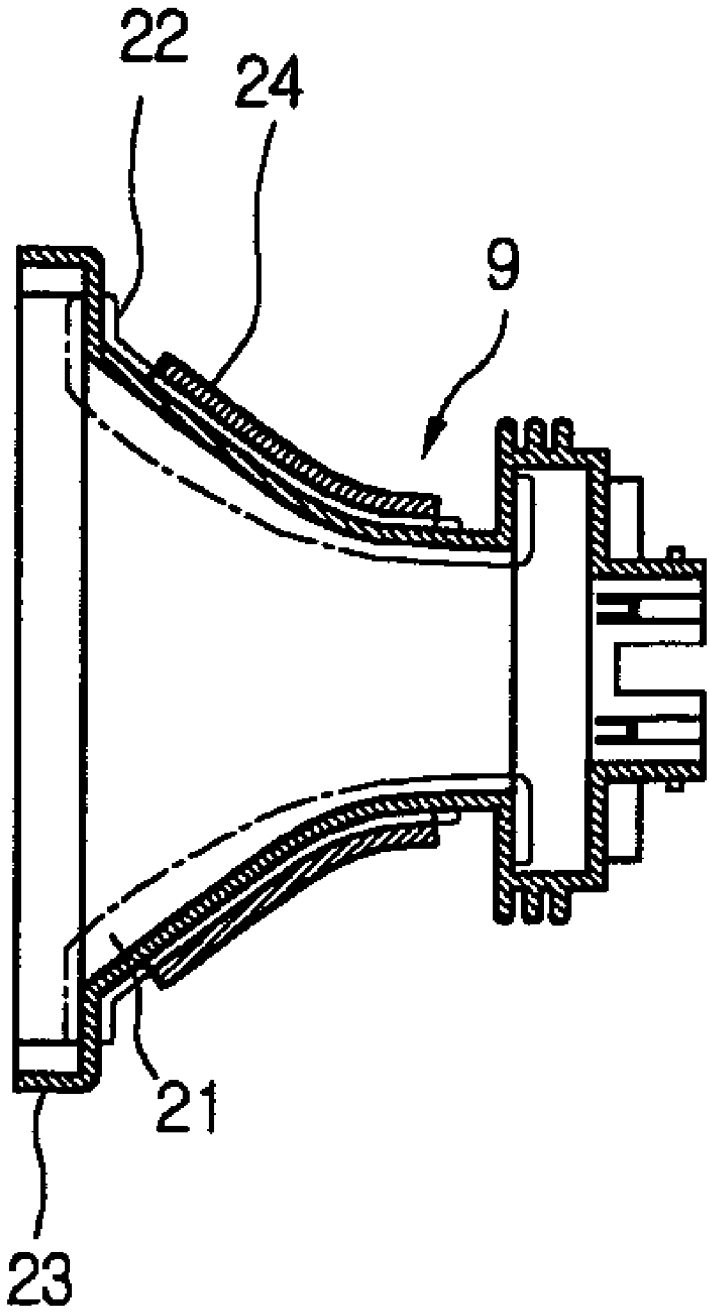
FIG. 4 illustrates a deflection yoke in a cathode ray tube according to the present invention.
Figure 5:
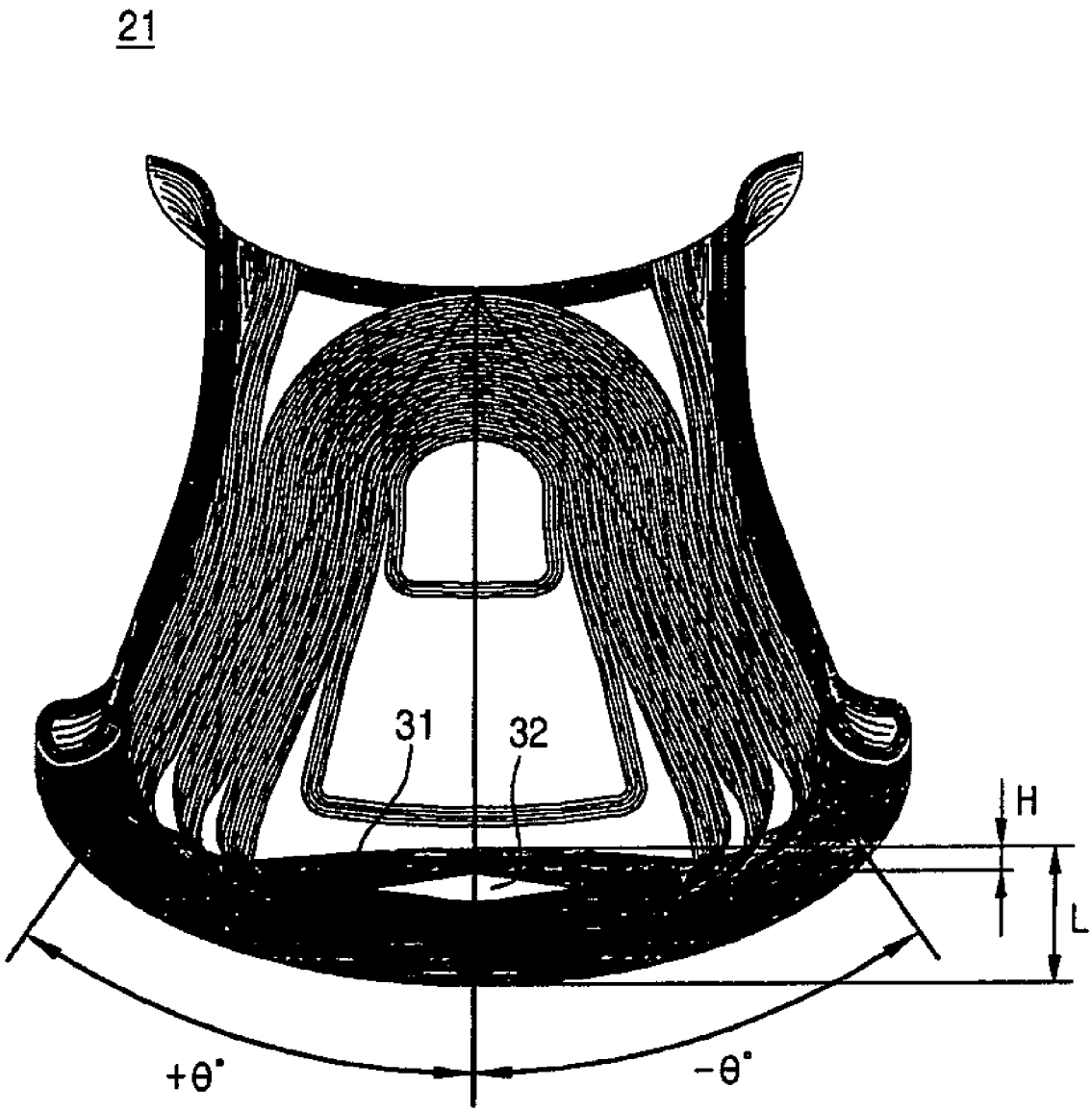
FIG. 5 illustrates a horizontal deflection coil of a deflection yoke in a cathode ray tube according to the present invention.

FIG. 4 illustrates a deflection yoke in a cathode ray tube according to the present invention, and FIG. 5 illustrates a horizontal deflection coil of the deflection yoke in the cathode ray tube.

As shown in FIGS. 4 and 5, the deflection yoke 9 of the cathode ray tube according to the present invention includes a horizontal deflection coil 21 for deflecting electron beams in a horizontal direction, a vertical deflection coil 22 for deflecting electron beams in a vertical direction, a ferrite core 24 for reducing a loss of magnetic fields generated by the horizontal and vertical deflection coils 21 and 22 on a return path thereof, and a holder 23 for insulating the horizontal and vertical deflection coils 21 and 22 with each other.

In a preferred embodiment of the present invention, an opening 32 is formed on a flange portion of an opening section of the horizontal deflection coil 2.

That is, the flange portion 31 of the opening section of the screen side is divided into at least two areas, and depending on the number of turns of this divided flange portion 31 of the opening section of the screen side, distortions in upper and lower portions can be easily adjusted.

More specifically, the flange portion 31 of the opening section of the screen side of the horizontal deflection coil 21 is divided into more than two areas, and the number of turns of each of the divided flange portions 31 is adjusted. In this manner, without using a separate correction member like a ferrite sheet, distortions in upper and lower portions of the deflection yoke 9 can be adjusted very easily.

Moreover, since the flange portion 31 of the opening section of the screen side of the horizontal deflection coil 21 is divided into more than two areas, magnetic field leakage is much reduced, and thus, a cancel coil for canceling the magnetic field leakage is not absolutely required any more.

In the drawing, 'L' denotes a maximum length of the flange portion 31 of the opening section on the screen side of the horizontal deflection coil 21, and 'H' denotes a distance from the opening 32 on the flange portion 31 of the opening section on the screen side of the horizontal deflection coil 21 to the direction of a neck side. Then, H/L preferably satisfies a condition of $0.15 \leqq H/L \leqq 0.45$.

When H/L satisfies the above condition, upper and lower distortions and magnetic field leakage problems can be overcome. More preferably, H/L satisfies a condition of $0.23 \leqq H/L \leqq 0.35$, to yield better results.

In addition, the opening 32 formed on the flange portion 31 of the opening section on the screen side of the horizontal deflection coil 21 is positioned within a designated angle ($\pm\theta$) from a center of the horizontal deflection coil 21. More specifically, the opening 32 is formed within ±45 degrees from the center of the horizontal deflection coil 21.

Figure 6:
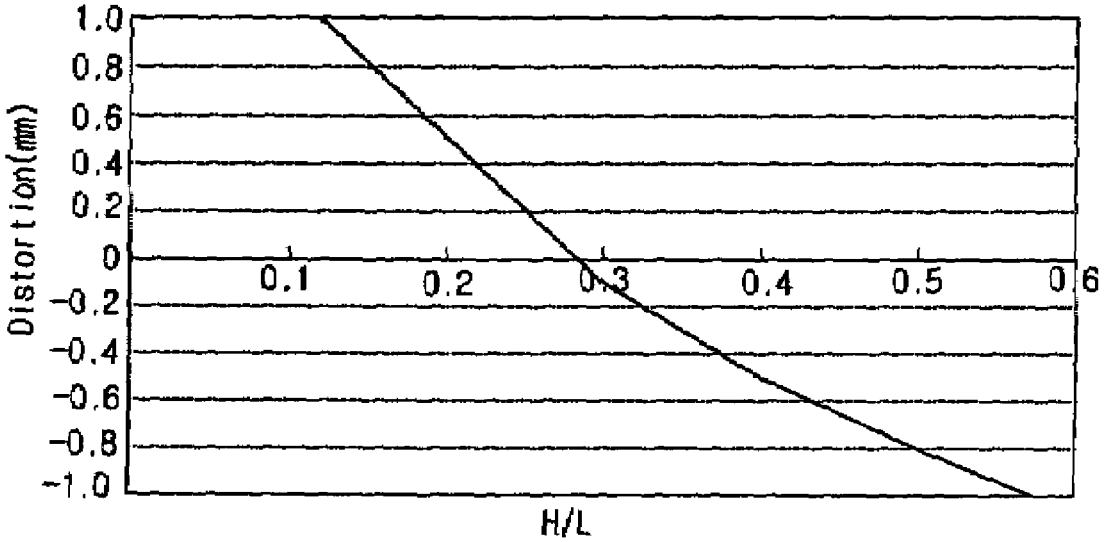
FIG. 6 illustrates an occurrence of distortion caused by a H/L change in a cathode ray tube according to the present invention.

FIG. 6 graphically illustrates a relation between distortion and a H/L change in a cathode ray tube according to the present invention.

As shown in FIG. 6, the distortion is very low when H/L satisfies the condition of $0.15 \leqq H/L \leqq 0.45$, and particularly, the distortion is minimum when H/L satisfies the condition of $0.23 \leqq H/L \leqq 0.35$.

In FIG. 6, (+) distortion values indicate barrel distortion, and (−) distortion values indicate pin-distortion.

On the other hand, distortion is also changed, depending on the number of turns included in H, the distance from a separation point on the flange portion 31 of the opening section on the screen side of the horizontal deflection coil 21 to the direction of the neck side. Preferably, the number of turns of the horizontal deflection coil 21 included in the H is in a range of 2 to 7.

Figure 7:
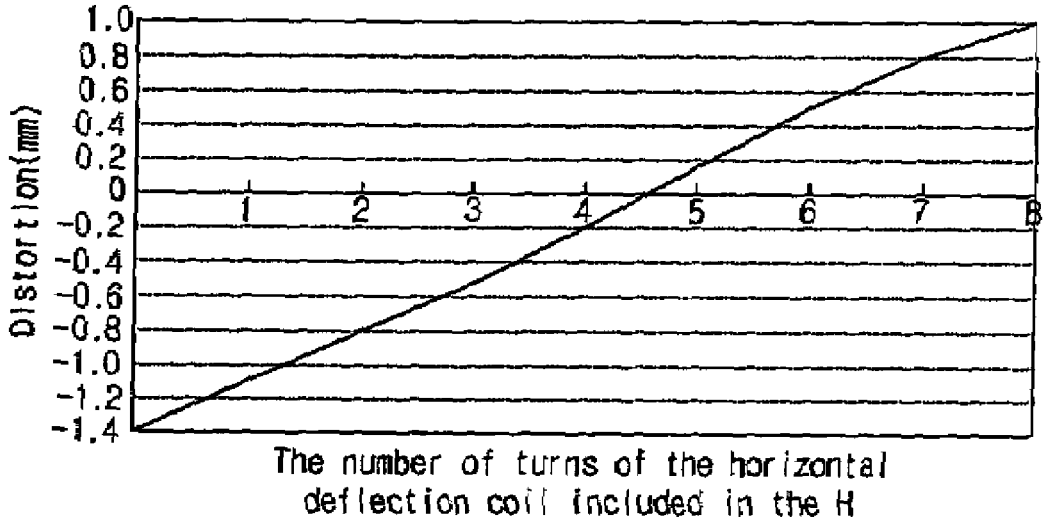
FIG. 7 illustrates a distortion amount in accordance with a number of turns of a horizontal deflection coil 21 included in H.

FIG. 7 depicts distortions in accordance with different numbers of turns of the horizontal deflection coil 21 included in the H.

As shown in FIG. 7, distortion is minimum when the number of turns of the horizontal deflection coil 21 included in the H is in a range of 2 to 7.

As are in FIG. 6, (+) distortion values indicate barrel distortion, and (−) distortion values indicate pin-distortion.

Figure 8:
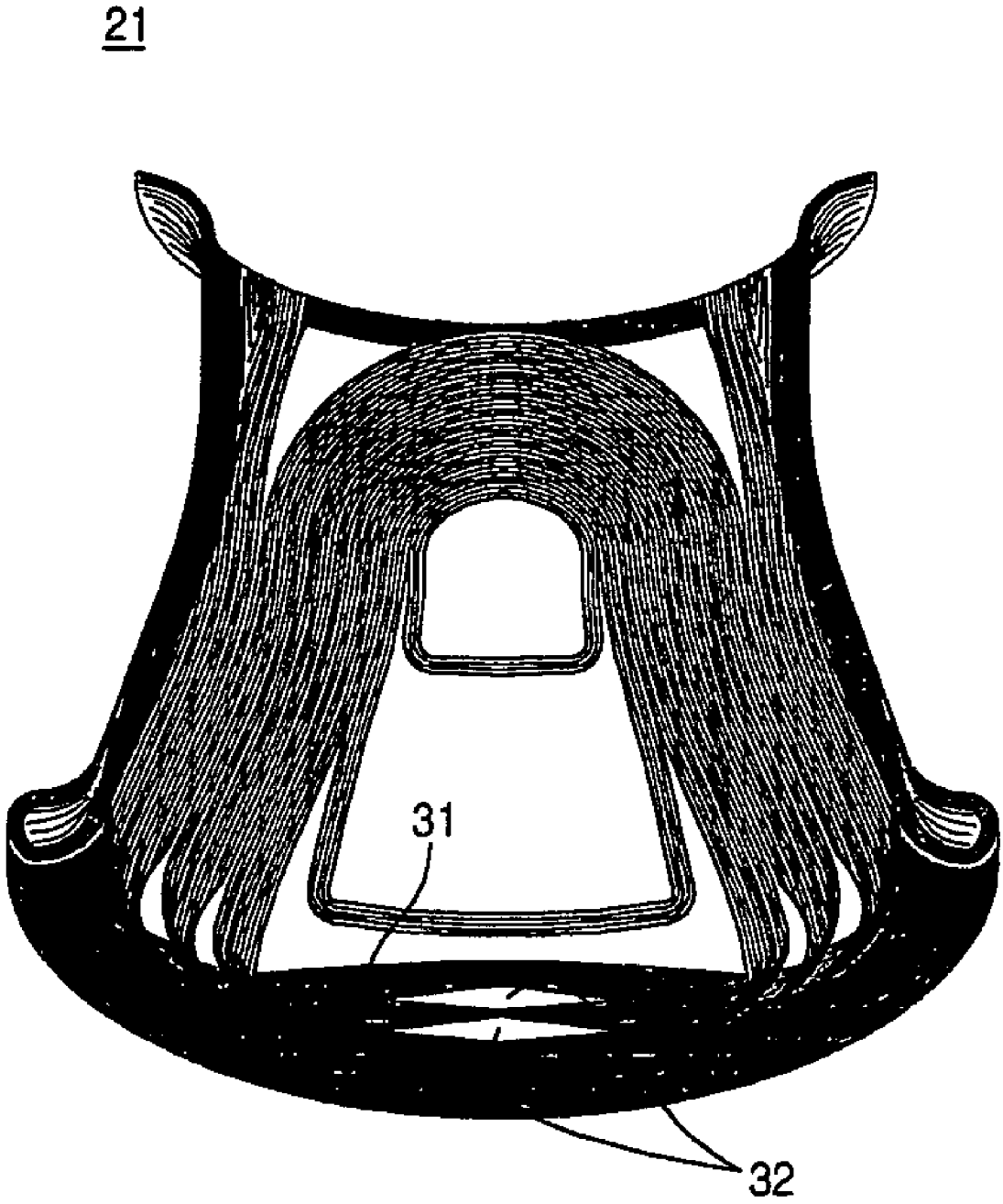
FIG. 8 illustrates another embodiment of a horizontal deflection coil of a deflection yoke in a cathode ray tube according to the present invention.

Lastly, FIG. 8 illustrates another embodiment of a horizontal deflection coil in a deflection yoke of a cathode ray tube according to the present invention.

In FIG. 8, the flange portion 31 of the opening section on the screen side of the horizontal deflection coil 21 is divided into three areas. That is to say, there are two openings 32 formed on the flange portion 31 of the opening section on the screen side.

As discussed before, since the flange portion 31 of the opening section of the screen side of the horizontal deflection coil 21 is divided into three areas, upper and lower distortions and magnetic field leakage problems can be solved.

Also, the horizontal deflection coil 21 is manufactured in a particular manner that the coil is fit in between an upper former and a lower former. To this end, a separation pin is inserted into a winding space of the coil to form the openings 32.

Here, the split pin is inserted in a position within ±15 degrees from a center of the horizontal deflection coil 21.

Although the present embodiment described the formation of openings 32 only on the horizontal deflection coil 21, equivalent effects are obtained from the formation of openings 32 on a vertical deflection coil 22.

In short, forming one or more openings 32 on the flange portion 31 of the opening section on the screen side of the horizontal deflection coil, the flange portion 31 of the opening section on the screen side of the horizontal deflection coil is split into at least two areas. This particular structure is effective for reducing distortions in upper and lower portions of the deflection yoke and solving the magnetic field leakage problem.

Also, since a separate magnetic field correction member or cancel coil is not needed, a manufacturing process is simplified and a cost of manufacture is also reduced.

Moreover, the present invention is advantageous in that its improved deflection efficiency can reduce power consumption.

While the invention has been shown and described with reference to certain preferred embodiments thereof, it will be understood by those skilled in the art that various changes in form and details may be made therein without departing from the spirit and scope of the invention as defined by the appended claims.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A cathode ray tube, comprising: a deflection yoke; a panel having a fluorescent screen on an inner surface; a funnel connected to the panel, an electron gun housed in the funnel; emitting electron beams; and a shadow mask for selecting colors of the electron beams emitted from the electron gun, wherein the deflection yoke comprises a deflection coil for deflecting the electron beams in horizontal and vertical directions, a holder for insulating the deflection coil, and a ferrite core for reducing a magnetic field generated by the deflection coil, and an opening is formed on a flange portion of an opening section on a screen side of the deflection coil;

wherein a maximum length of the flange portion of the opening section on the screen side of the deflection coil, L, and a length of the flange portion of the opening section on the screen side, starting from the opening to the direction of a neck, H, satisfy a condition of $0.15 \leqq H/L \leqq 0.45$.

2. The cathode ray tube according to claim 1, wherein a maximum length of the flange portion of the opening section on the screen side of the deflection coil, L, and a length of the flange portion of the opening section on the screen side, starting from the opening to the direction of a neck, H, satisfy a condition of $0.23 \leqq H/L \leqq 0.35$.

3. The cathode ray tube according to claim 1, wherein the opening is formed within ±45 degrees from a center of the deflection coil.

4. The cathode ray tube according to claim 1, wherein the deflection coil is a horizontal deflection coil.

5. The cathode ray tube according to claim 1, wherein a number of turns of the deflection coil covering a length (H) of the flange portion of the opening section on the screen side from the opening to the direction of the neck ranges from 2 to 7.

6. A cathode ray tube, comprising: a deflection yoke; a panel having a fluorescent screen on an inner surface; a funnel connected to the panel, an electron gun housed in the funnel; emitting electron beams; and a shadow mask for selecting colors of the electron beams emitted from the electron gun, wherein the deflection yoke comprises a deflection coil for deflecting the electron beams in horizontal and vertical directions, a holder for insulating the deflection coil, and a ferrite core for reducing a magnetic field generated by the deflection coil, and a flange portion of an opening section on a screen side of the deflection coil is split into at least two areas;

wherein a maximum length of the flange portion of the opening section on the screen side of the deflection coil, L, and a length of the flange portion of the opening section on the screen side, starting from the opening to the direction of a neck, H, satisfy a condition of $0.15 \leqq H/L \leqq 0.45$.

7. The cathode ray tube according to claim 6, wherein a maximum length of the flange portion of the opening section on the screen side of the deflection coil, L, and a length of the flange portion of the opening section on the screen side, starting from the opening to the direction of a neck, H, satisfy a condition of $0.23 \leqq H/L \leqq 0.35$.

8. The cathode ray tube according to claim 6, wherein the opening is formed within ±45 degrees from a center of the deflection coil.

9. The cathode ray tube according to claim 6, wherein the deflection coil is a horizontal deflection coil.

10. The cathode ray tube according to claim 6, wherein a number of turns of the deflection coil covering a length of the flange portion of the opening section on the screen side from the opening to the direction of the neck ranges from 2 to 7.

11. A manufacturing method of a deflection coil for deflecting electron beams in horizontal and vertical directions, the method comprising the steps of:

inserting the deflection coil between an upper former and a lower former; and forming an opening by inserting a split pin on a flange portion of an opening section on a screen side of the deflection coil;

wherein the split pin is inserted to a position satisfying a condition of $0.15 \leqq H/L \leqq 0.45$, L denoting a maximum length of the flange portion of the opening section on the screen side of the deflection coil, and H denoting a length of the flange portion of the opening section on the screen side, starting from the opening to the direction of a neck.

12. The cathode ray tube according to claim 11, wherein the split pin is inserted within ±15 degrees from a center of the deflection coil.

13. The cathode ray tube according to claim 11, wherein the split pin is inserted to a position satisfying a condition of $0.23 \leqq H/L \leqq 0.35$, L denoting a maximum length of the flange portion of the opening section on the screen side of the deflection coil, and H denoting a length of the flange portion of the opening section on the screen side, starting from the opening to the direction of a neck.

14. The cathode ray tube according to claim 11, wherein the opening is formed within ±45 degrees from a center of the deflection coil.

15. The cathode ray tube according to claim 11, wherein the deflection coil is a horizontal deflection coil.

16. The cathode ray tube according to claim 11, wherein a number of turns of the deflection coil covering a length (H) of the flange portion of the opening section on the screen side from the opening to the direction of the neck ranges from 2 to 7.

* * * * *